US006543183B1

(12) United States Patent
McNaughton

(10) Patent No.: US 6,543,183 B1
(45) **Date of Patent: *Apr. 8, 2003**

(54) FLEXIBLE VASE

(75) Inventor: Patrick J. McNaughton, Plymouth, MN (US)

(73) Assignee: McNaughton, Incorporated, Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/165,405

(22) Filed: Oct. 2, 1998

(51) Int. Cl.[7] ..... A47G 7/06
(52) U.S. Cl. ..... 47/41.01
(58) Field of Search ..... 47/44.01, 44.11, 47/44.12, 44.13, 44.15, 63, 72, 30; 53/397; 206/205, 423, 829; 248/300, 363; 383/7, 11, 110; 607/108

(56) References Cited

U.S. PATENT DOCUMENTS

| | | | | | |
|---|---|---|---|---|---|
| 1,116,932 | A | * | 11/1914 | Schwartz et al. | 383/110 |
| 1,725,490 | A | | 8/1929 | Talbot | |
| 1,739,801 | A | | 12/1929 | Pitts | |
| 1,828,295 | A | | 10/1931 | Roy | |
| 2,024,429 | A | * | 12/1935 | Casey | 383/7 |
| 2,202,242 | A | * | 5/1940 | Wortham | 248/300 |
| 2,246,490 | A | | 6/1941 | Flues | |
| 2,691,849 | A | | 10/1954 | Ehlers, Sr. | |
| 2,698,155 | A | | 12/1954 | Bowman | |
| 2,739,632 | A | * | 3/1956 | Rodriguez | 383/11 |
| 2,756,542 | A | | 7/1956 | Mossman | |
| 2,774,187 | A | | 12/1956 | Smithers | |
| 2,938,297 | A | | 5/1960 | Greene | |
| 3,323,640 | A | * | 6/1967 | Kugler | 206/205 |
| 3,556,389 | A | | 1/1971 | Gregoire | |
| 3,874,115 | A | | 4/1975 | London et al. | |
| 4,091,925 | A | | 5/1978 | Griffo et al. | |
| 4,149,339 | A | * | 4/1979 | Hall et al. | 47/67 |
| 4,801,014 | A | | 1/1989 | Meadows | |
| 4,878,580 | A | * | 11/1989 | Johnston | 206/216 |
| 4,946,290 | A | | 8/1990 | Matyja | |
| 5,127,187 | A | * | 7/1992 | Hattori et al. | 47/59 |
| 5,228,234 | A | | 7/1993 | de Klerk et al. | |
| 5,235,782 | A | | 8/1993 | Landau | |
| 5,315,782 | A | | 5/1994 | Barclay et al. | |
| 5,388,695 | A | * | 2/1995 | Gilbert | 206/423 |
| 5,403,634 | A | | 4/1995 | Mauffette | |
| 5,493,809 | A | | 2/1996 | Weder et al. | |
| 5,534,020 | A | * | 7/1996 | Cheney, III et al. | 607/108 |
| 5,572,826 | A | | 11/1996 | Weder | |
| 5,647,168 | A | | 7/1997 | Gilbert | |
| 5,899,047 | A | * | 5/1999 | Weder et al. | 53/397 |
| 6,041,546 | A | * | 3/2000 | Baranova | 47/65.8 |

* cited by examiner

*Primary Examiner*—Charles T. Jordan
*Assistant Examiner*—Francis T. Palo
(74) *Attorney, Agent, or Firm*—Fredrikson & Byron, P.A.

(57) ABSTRACT

A flexible vase that is suspendible from a smooth surface is disclosed. The vase is formed by a watertight pouch that has an open mouth for receiving flowers. The pouch is formed by sealing the edges of two layers of flexible, watertight materials together. One of the pouch layers extends beyond the other at the mouth to form a flap. The flap has an oval button hole. The vase also uses a suction cup that may be mounted to a smooth surface. The back of the cup has a button and a shaft between the button and the back of the cup. The pouch may be removably suspendible from the suction cup by stretching the oval button hole over the button and onto the shaft. The vase may also have a transparent pocket for receiving a card. The vase may also be dispensed from a perforated roll of two-ply material such as polyethylene.

3 Claims, 7 Drawing Sheets

FLEXIBLE VASE

TECHNICAL FIELD

The present invention relates in general to vases, and more specifically, to flexible vases suitable for holding flowers or rooting plant stems and suspendible from smooth surfaces.

BACKGROUND OF THE INVENTION

Typical vases are bulky, heavy, and expensive. At the time of purchasing flowers, such vases cannot be sold with the flowers without adding appreciable cost and difficulty of shipment.

In addition, typical vases are not suitable for use in rough, unstable environments, such as in a moving vehicle. Such vases would likely tip over from the vehicle's acceleration or encounter with rough terrain, spilling all the vase's contents and, depending upon vase's construction, shattering the vase.

Certain receptacles, which could possibly serve as vases, have metal tabs, rings or hooks that are used to hang the receptacles from walls or other suitable structures. Once such receptacles are placed in position, however, they cannot be removed or relocated very easily. For instance, in order to suspend such receptacles from walls it is further necessary to have a hook or nail provided upon the wall to receive the receptacle's tab or ring. Once in place, the receptacle cannot be removed without leaving an unsightly hook or nail. In addition, the unsightly nail or hook cannot be removed without leaving a mark on the wall, because the nail or hook must be driven or embedded into the wall. Besides not being able to easily remove or relocate such receptacles, many wall surfaces are ill-suited for such receptacles. For instance, it may be impossible to drive a nail or hook into a wall constructed of tile, glass, thin plastic, etc. without cracking or shattering the wall.

SUMMARY OF THE INVENTION

The present invention provides a flexible vase that is easily and removably suspendible from a smooth surface. A preferred embodiment of the vase includes a watertight pouch that has an upwardly facing open mouth for receiving flowers into the pouch. The pouch is comprised of two generally planar wall portions that are made of flexible, water impervious material and that are disposed so as to face each other. To form the pouch, the peripheries of the wall portions are sealed together other than at the mouth, which is left open. One wall portion may extend beyond the other at the open mouth to form a flap. The flap has an button hole with a corresponding flexible hole periphery. The vase also includes an all-flexible suction cup that has a cup side and a button side opposite the cup side. The cup side is adapted for mounting to a smooth surface. The button side has a shaft extending axially from the cup side that terminates in a button which has a cross-section greater than that of the shaft. The shaft and button may be formed integrally with the cup side. The pouch is removably downwardly suspendible from the suction cup by stretching the periphery over the button to surround the shaft. Since the pouch and the cup are both comprised of flexible materials, their connection creates an all-flexible union.

In an alternative embodiment, the pouch has a card pocket comprised of a layer of flexible material that is sealed to one of the pouch's wall portions. The pocket has an open mouth for receiving a card into the space between the layer and the one of the wall portions.

In yet another alternative embodiment, a sheet of the vases is conveniently provided on a roll. Each vase has a pouch that is comprised of sealed inner and outer plies of a flexible water impervious material. The pouch has an upwardly open mouth for receiving flowers into the interior space between the sealed plies. Each pouch has at least two laterally opposed edges, and each is connected to at least one other pouch along one edge by a readily severable joint. These connections form a rollable sheet of vases. One ply of each vase extends beyond the other ply at the open mouth to form a flap that has a button hole with a corresponding button hole periphery. The pouch is removably downwardly suspendible from its button hole periphery.

DETAILED DESCRIPTION OF THE INVENTION

Figure 1:
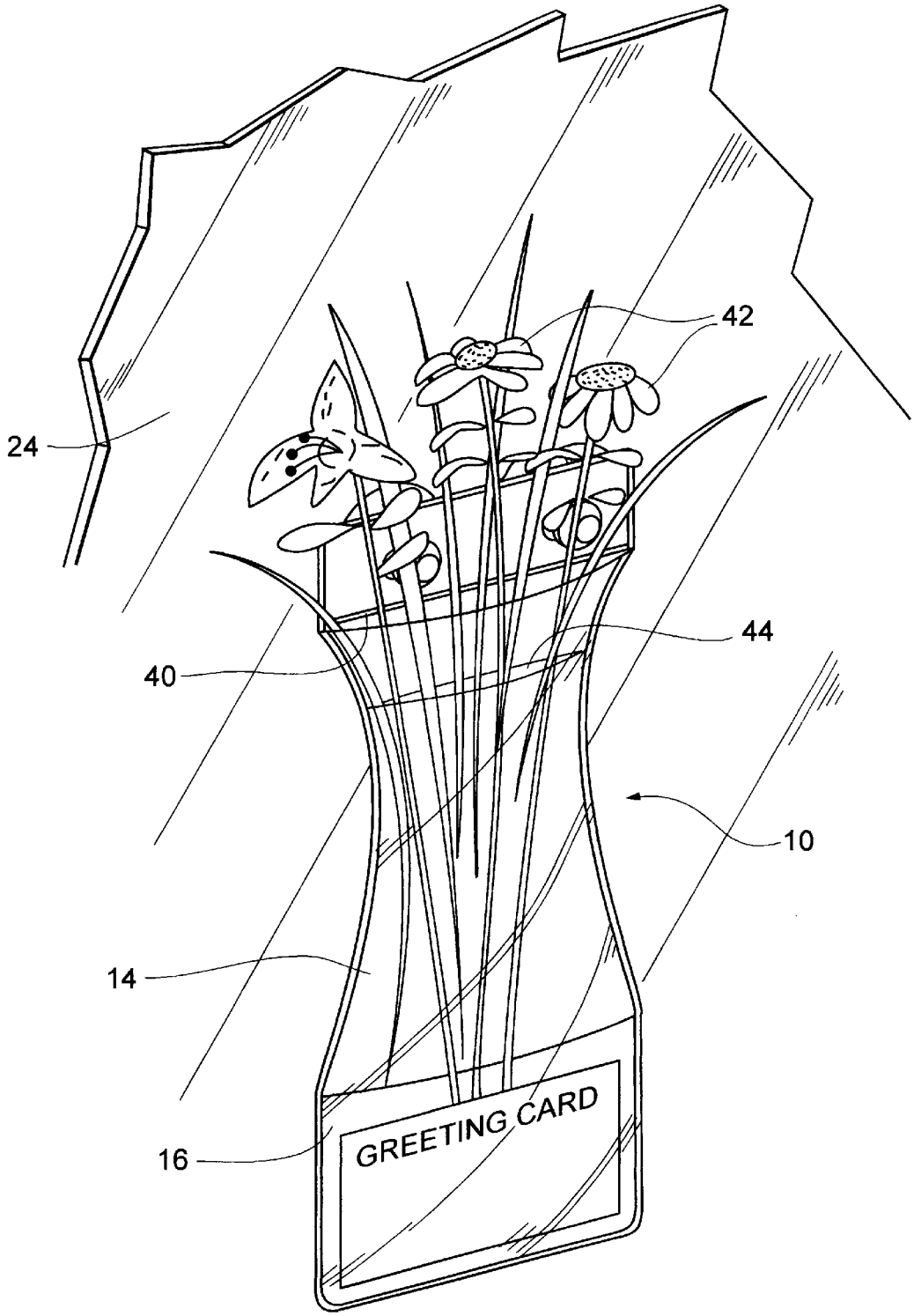
FIG. 1 is a perspective view of a first embodiment of the present invention.

The drawings depict a preferred embodiment of a flexible vase of the invention. It will be understood, however, that many of the specific details of the flexible vases illustrated in the drawings could be changed or modified by one of ordinary skill in the art without departing significantly from the spirit of the invention.

A preferred embodiment of the flexible vase 10 is shown in perspective view in FIG. 1. As shown by the exploded view of the flexible vase 10 in FIG. 2, the vase 10 is comprised of at least one suction cup 12 and a watertight pouch 14. Although the preferred pouch shape is shown, the pouch may be constructed in any of a variety of shapes. The pouch 14 may also contain a front pocket 16 suitable for holding and displaying a greeting card 18 or a card containing other printed indicia.

Figure 2:
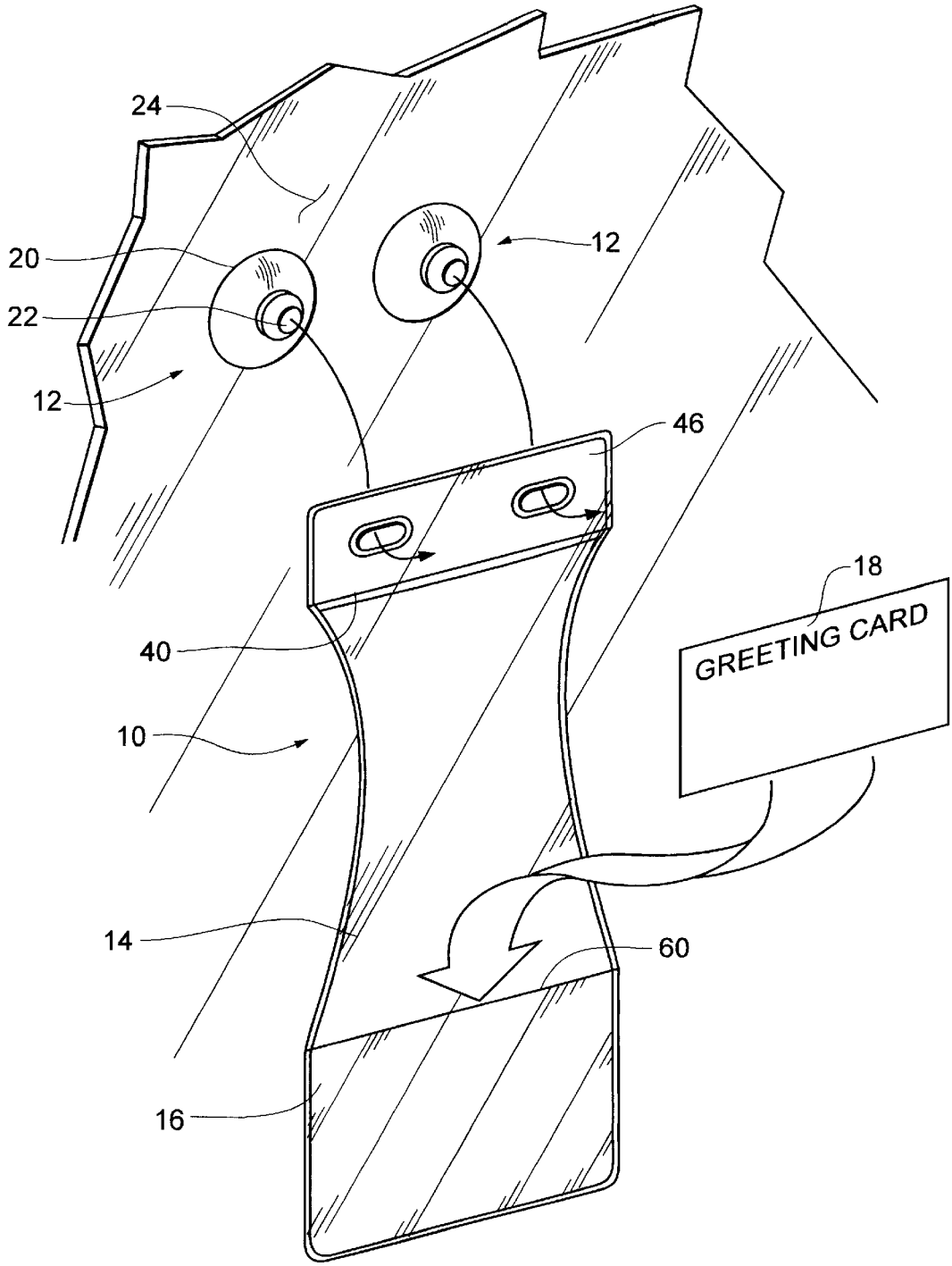
FIG. 2 is an exploded perspective view of the embodiment shown in FIG. 1.
Figure 4:
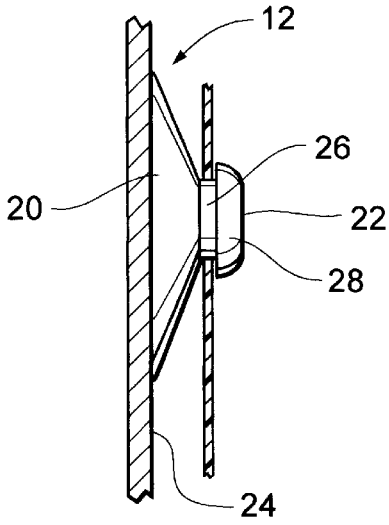
FIG. 4 is a detailed sectional side view of the suction cup of the first embodiment of the present invention.

With reference to FIGS. 2 and 4, each suction cup 12 has a cup side 20 and a button side 22 opposite the cup side 20. The cup side 20 is suitable for repeated suction mounting to a generally smooth and, preferably, non-porous and vertical, surface 24. The suction cup 12 may therefore be made of soft rubber, vinyl, or any other pliable (preferably non-metallic) material suitable for this purpose, such that the suction cup 12 will be entirely comprised of flexible material. The button side 22 of the cup 12 has a shaft 26 that extends axially (shown horizontally in FIGS. 2 and 4) from the cup side 20 that terminates in an enlarged flange or button 28. The button 28 need not be any particular shape. However, since the pouch 14 will be hooked on (and, therefore, hang downwardly from) the suction cup 12, as will be described below, the cross-sectional area of the button 28 must be larger than that of the shaft 26. Both the shaft 26 and button 28 are preferably formed integrally with the cup side 20, and may therefore be made of the same pliable material as the cup side 20.

Figure 3:
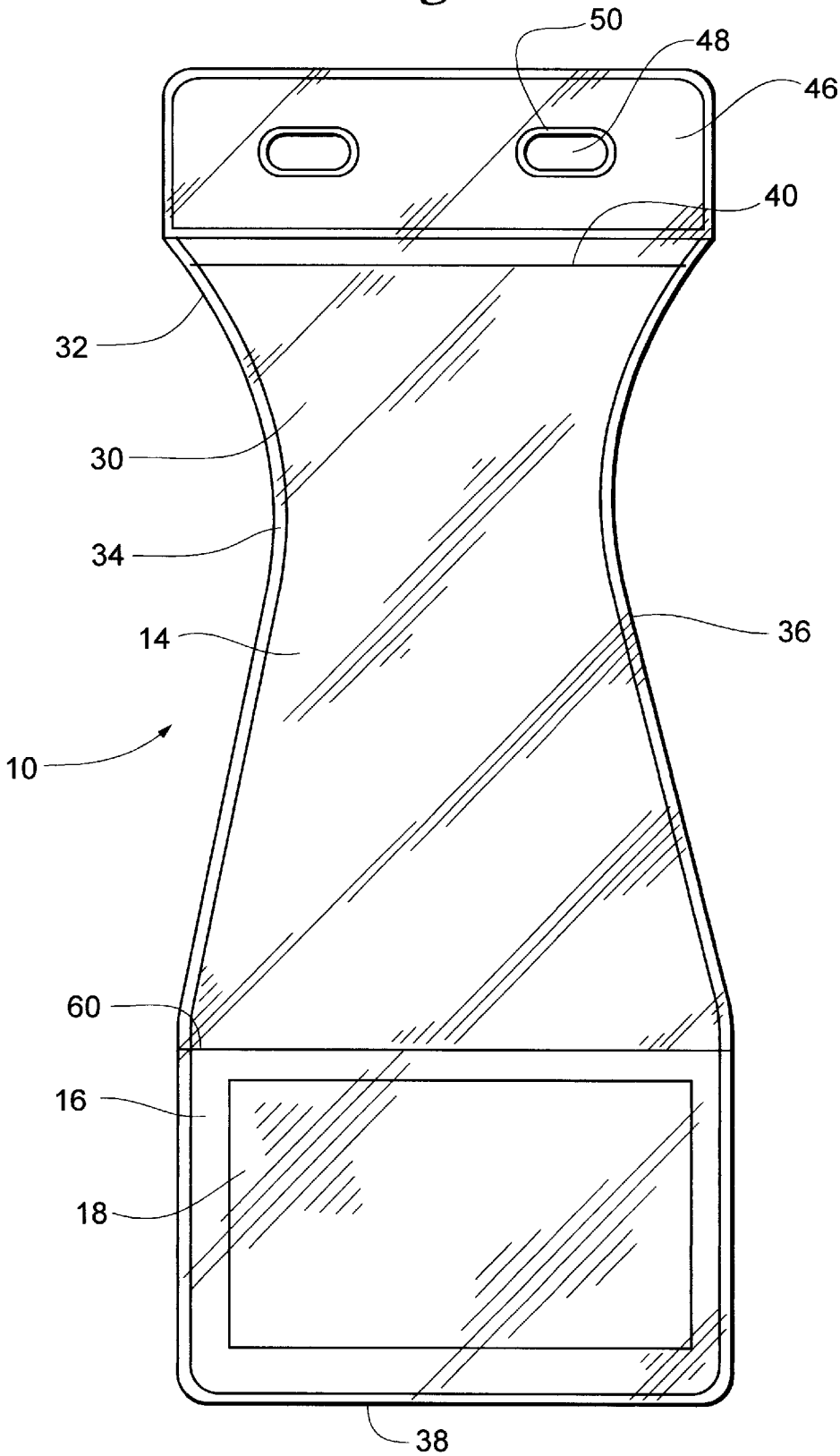
FIG. 3 is a front elevational view of the embodiment shown in FIG. 1.

With reference to FIG. 3, the pouch 14 may be comprised of a front 30 and a back 32 layer, ply, wall, etc. of a generally planar, flexible, water impervious material, such as vinyl, rubber, plastic, polyethylene, polypropylene, etc. By using a flexible material, the vases 10 flatten and may be rolled or folded for easy storage when not in use. One or both of the pouch layers may range anywhere from being transparent, so as to permit clear viewing of the vase's contents, to being opaque, so as to block or filter unwanted light. For instance, the layers could be made to block or filter light from plant stems and roots to reduce radiant heating or to permit rooting. The two layers may be comprised of two, separate sheets of material, or they may be part of one sheet that is folded over.

To form the pouch 14, the layers 30, 32 are sealed watertight along their periphery at the left 34 and right 36 edges and the bottom 38. The layers may be sealed by conventional means such as heat sealing, bonding, etc. Any of the sealed edges 34–38 may also be the folded edge described above if a single sheet is used to construct the layers. The upwardly facing mouth 40 is left open and unsealed. As shown in FIG. 1, the mouth 40 may be used to receive flowers 42, water 44, or other items (such as soil, beads, etc) into the interior space of the pouch 14 defined by the space between the sealed layers 30, 32. Due to the flexibility of the vase's walls, the walls may be flexed from a generally flat position, where the wall portions are generally parallel and in contact, to an open position, where the wall portions, except at their seals, are spaced from each other to define an interior space. In use, this interior space will expand to accommodate the items inserted into it.

With reference back to FIG. 3, one layer of the pouch 14 preferably extends upward beyond the mouth 40 to form a flap 46. The flap 46 need not be rectangular as shown. The flap contains at least one button hole 48 having a corresponding periphery 50. The button holes are shown as oval-shaped. However, the button holes may be of any appropriate shape, such as a slit, a slot, circular, rectangular, a slit with reinforced edges or ends, a slit with circular cutouts at each end, etc. In addition, the button holes 48 may be oriented horizontally, as shown, vertically, or in any other orientation. No matter what shape, the button holes must be sized for proper button/button hole engagement with the button. In addition, the button hole periphery 50 must remain flexible (e.g., the periphery should not be reinforced by a metal or rigid plastic grommet).

Using a flexible button hole periphery 50, the periphery (like any button and button hole) may be stretched or merely deformed over the button 28 and onto the shaft 26 to fasten the pouch to the suction cup. Under loaded conditions (such as when the vase is filled with water), the periphery 50 will be pulled downward and stretched around the button shaft. By surrounding the shaft, the periphery will not easily slip backwards over the button. Thus, the vase 10 may be used in rough environments, such as in a car.

The use of flexible materials for the button and periphery permits easy and repeatable connection and disconnection of the pouch 14 and the suction cup 12. The periphery 50 may be repeatedly fastened to and unfastened from the suction cup without permanently deforming the periphery shape and without disturbing the suction cup from its position. Thus, in use, the suction cup may be vacuum suctioned to a smooth surface before or after the pouch 14 is fastened to the suction cup through the periphery.

In addition, the use of flexible materials avoids problems such as scratching or rusting. For instance, if a metal hook were used on the suction cup instead of the flexible button, the metal hook could inadvertently scratch the smooth surface 24 during use. In addition, if the periphery were reinforced with a metal grommet, the metal is apt to rust under the normal wet conditions associated with using a flower vase.

Figure 5:
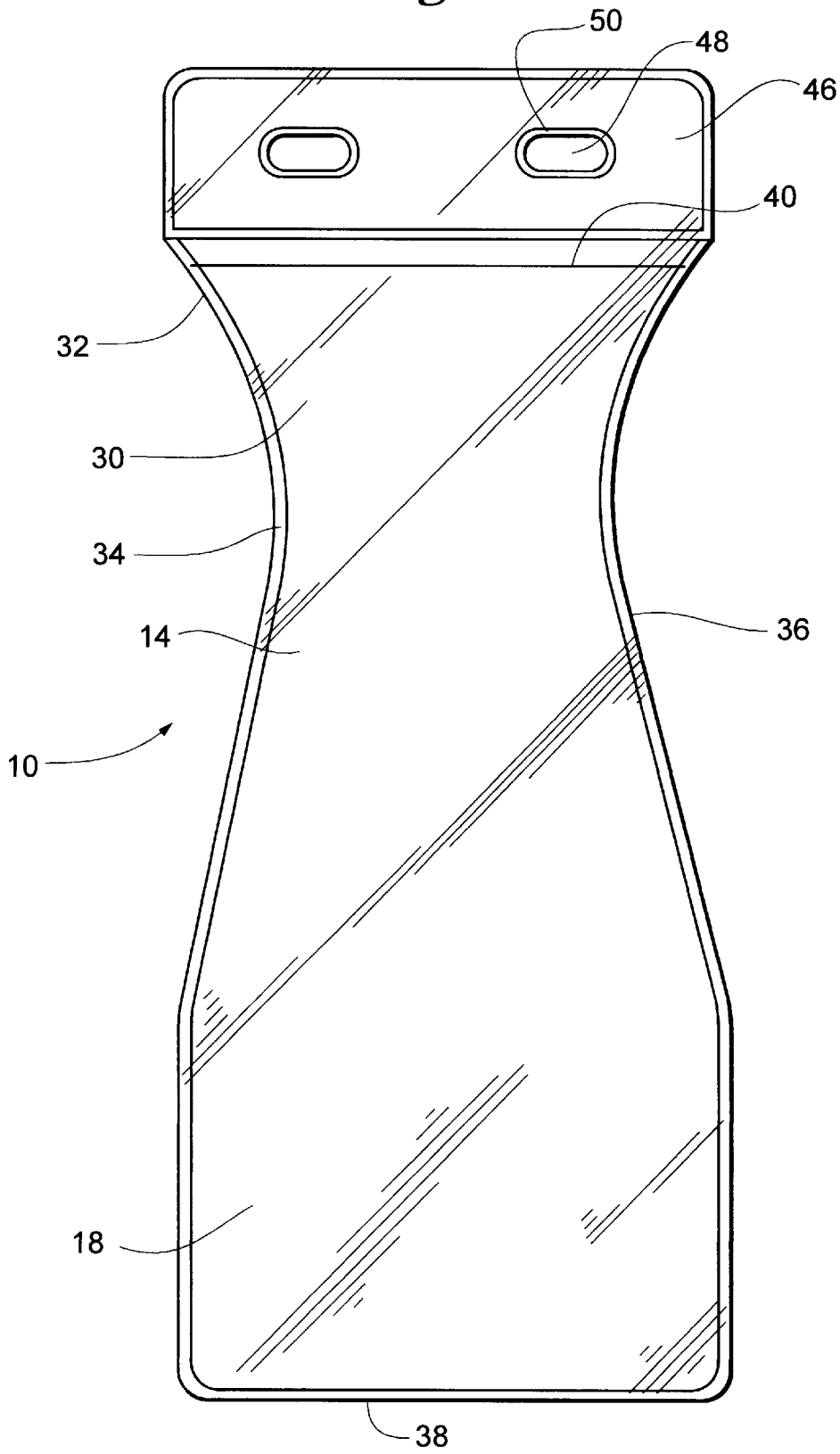
FIG. 5 is an elevational view of a second embodiment of the present invention.

As shown in FIGS. 1–3, the pouch 14 may also contain a front pocket 16 suitable for holding and displaying a greeting card 18, business card, announcement, or any type of card containing printed indicia, such as a logo. Such a logo may also be printed directly on the vase 10. The pocket 16 is comprised of a layer of flexible and, preferably, clear material, possibly the same material as the pouch layers 30, 32. The pocket 16 is sealed along its periphery to at least the front pouch layer 30. A mouth 60 is left open and unsealed for receiving a card, as shown in FIG. 2, into the space between the pocket and the pouch layer. The pocket 16 need not be upwardly open, but may also be open from a side. As shown in FIG. 5, the vase 10 may also be constructed without a pocket.

Figure 6:
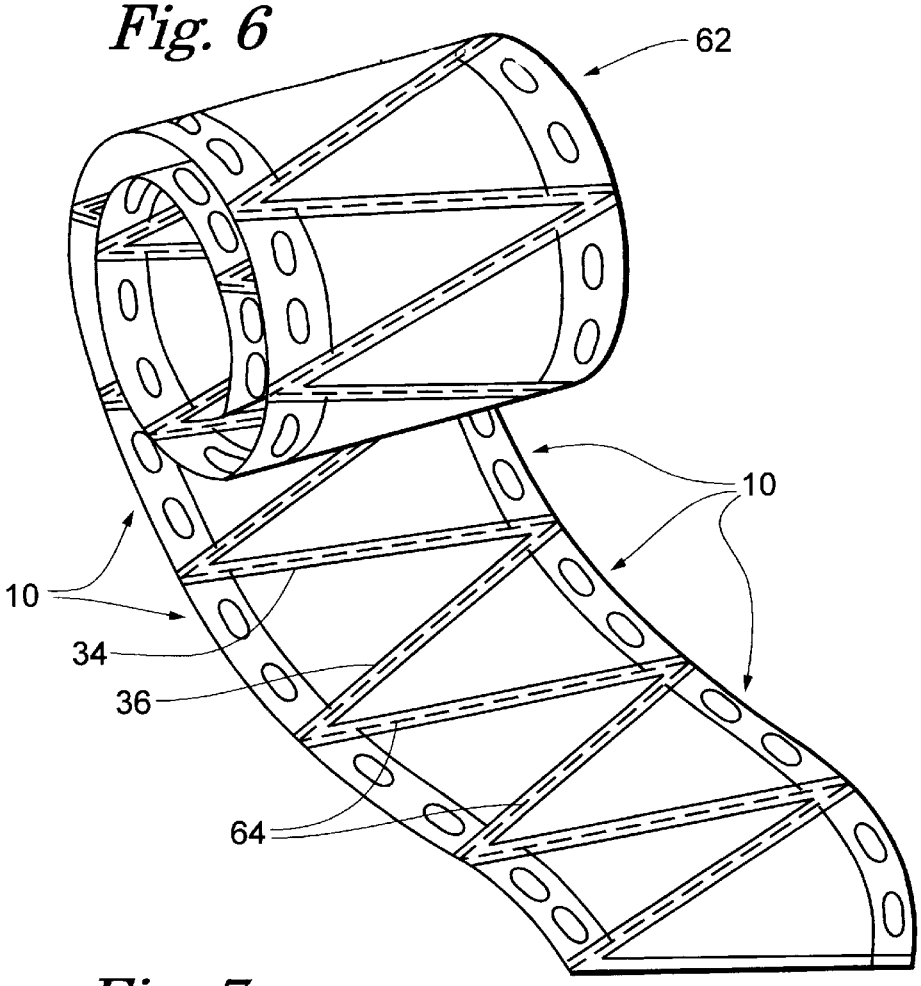
FIG. 6 is a perspective view of a third embodiment of the present invention.

As shown in FIG. 6, a supply of vases 10 may be dispensed from a sheet or roll 62. The individual roll vases 10 are constructed the same as the individual vases described above. The vases 10 are sealed along at least left 34 and right 36 edges to form a pouch having an upwardly open mouth. One of the pouch layers extends beyond the other to form a flap that has at least one oval button hole. The button hole is sized to be easily connected to and disconnected from a suction cup button so as to permit the vase to be suspended from the suction cup.

As needed, individual roll vases 10 may be easily severed from the roll 62 along a seam or joint 64. The joint 64 may be any readily severable seam, such as a pattern of dotted-line perforations. The roll 62 may be comprised of two layers (or a single layer folded over) of a flexible, water impervious material. The roll material is preferably comprised of extruded polyethylene. Such material permits the creation of an inexpensive, single-use vase. However, any of the materials disclosed above may be used.

Figure 8:
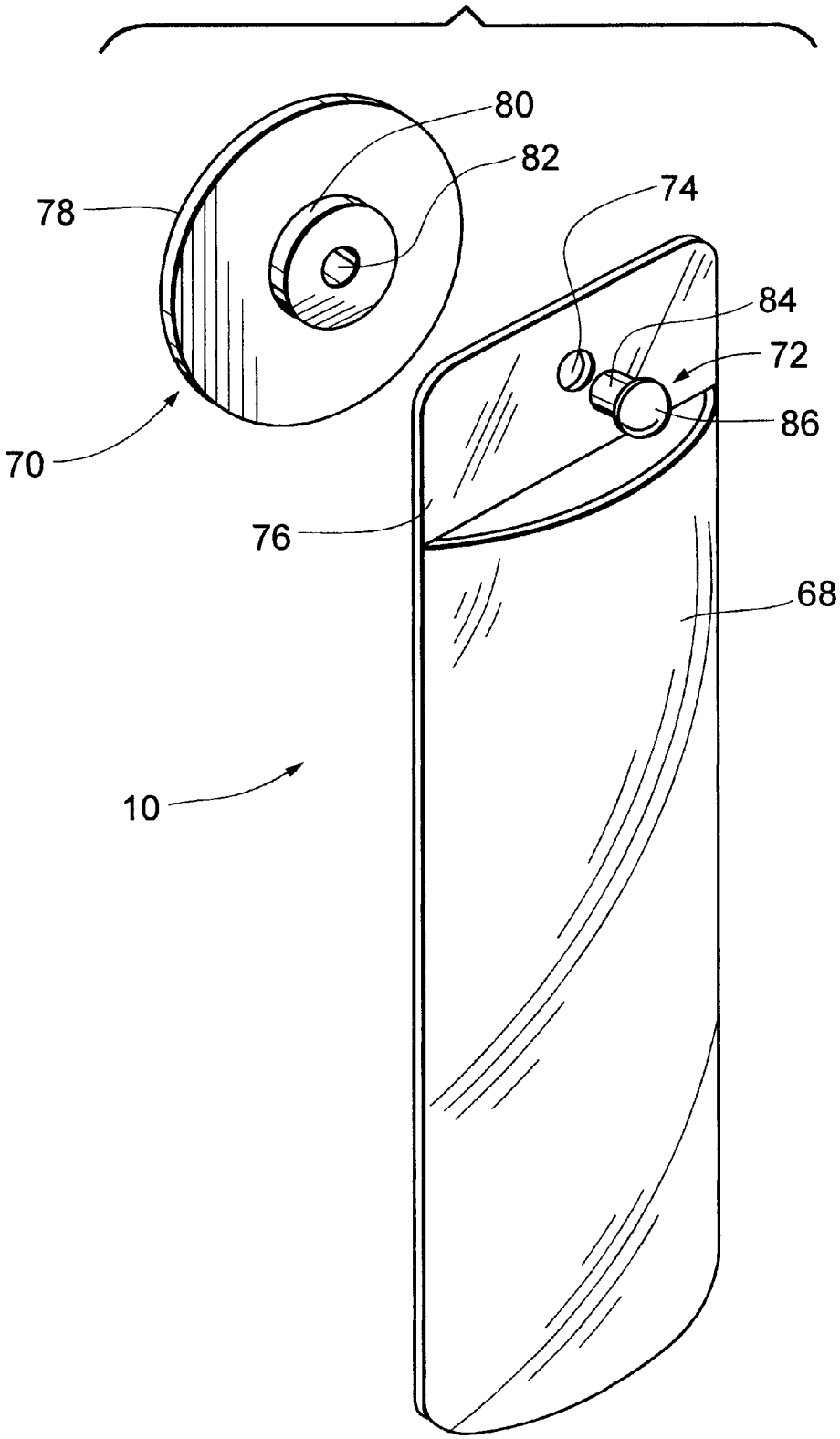
FIG. 8 is a perspective view of a fifth embodiment of the present invention.

In an alternate embodiment (shown in FIG. 8), the vase 10 may be comprised of a pouch 68, a modified suction cup 70, and a pin 72. The vase 10 is again downwardly suspendible from the suction cup 70 via a pin hole 74. The pin hole 74 is located on one of the walls of the vase 10, and, preferably, on a flap 76 of the wall that extends beyond the other wall at the mouth of the vase. The suction cup 70, similar to the suction cup 12, has a cup side 78 for repeatable suction attachment to a smooth, non-porous surface. The side opposite the cup side has a shaft 80 extending axially from the cup side that has a pin receptacle 82. The pin receptacle 82 is adapted for receiving and frictionally engaging the stem 84 of the pin 72. The pouch 68 may be coupled to and suspended from the suction cup 70 by inserting the pin stem 84 through the pin hole 74 and into frictional engagement with the pin receptacle 82. The head 86 of the pin 72 should be larger than the pin hole 74 so as to prevent the pouch 68 from slipping off the pin stem 84. The vase 10 shown in FIG. 8 may also be dispensed from a rollable sheet of vases as shown in FIG. 6.

The use of flexible materials for the pin 72 and the suction cup 70 permits easy and repeatable connection and disconnection of the pouch 68 and the suction cup 70. The pin 72 may be repeatedly engaged to and disengaged from the suction cup without disturbing the suction cup from its position. Thus, in use, the suction cup may be vacuum suctioned to a smooth surface before or after the pouch 68 is fastened to the suction cup. In addition, the engagement of the pin, suction cup, and the pouch creates an all-flexible union that avoids problems such as rusting and scratching.

In yet another alternate embodiment (shown in FIG. 9), the vase 10 may be comprised of a pouch 88, two card pockets 90, 92, and two suction cups 12. The pouch 88 and card pockets 90, 92 may be comprised of front 94 and back 96 plies of the flexible, water impervious material discussed above. The plies may be formed from two, separate sheets of material, or they may be part of one sheet that is folded over on itself.

To form the watertight pouch 88 and the card pockets 90, 92, the plies 94, 96 are sealed together along seams 98. An upwardly facing mouth 100 of the pouch is left open and unsealed for receiving items into the interior space between the plies and bounded by the seams. Each of the card pockets 90, 92 also has an open, unsealed mouth 102, 104. These mouths 102, 104, which may open to the side or to the top, may be used to receive a card, photo, etc. 18 inserted into the interior space between the plies and bounded by the seams. Other configurations of the vase shown in FIG. 8 may be formed by simply modifying the location of the seams 98. The vase 10 shown in FIG. 9 may also be dispensed from a rollable sheet of vases as shown in FIG. 6.

Figure 9:
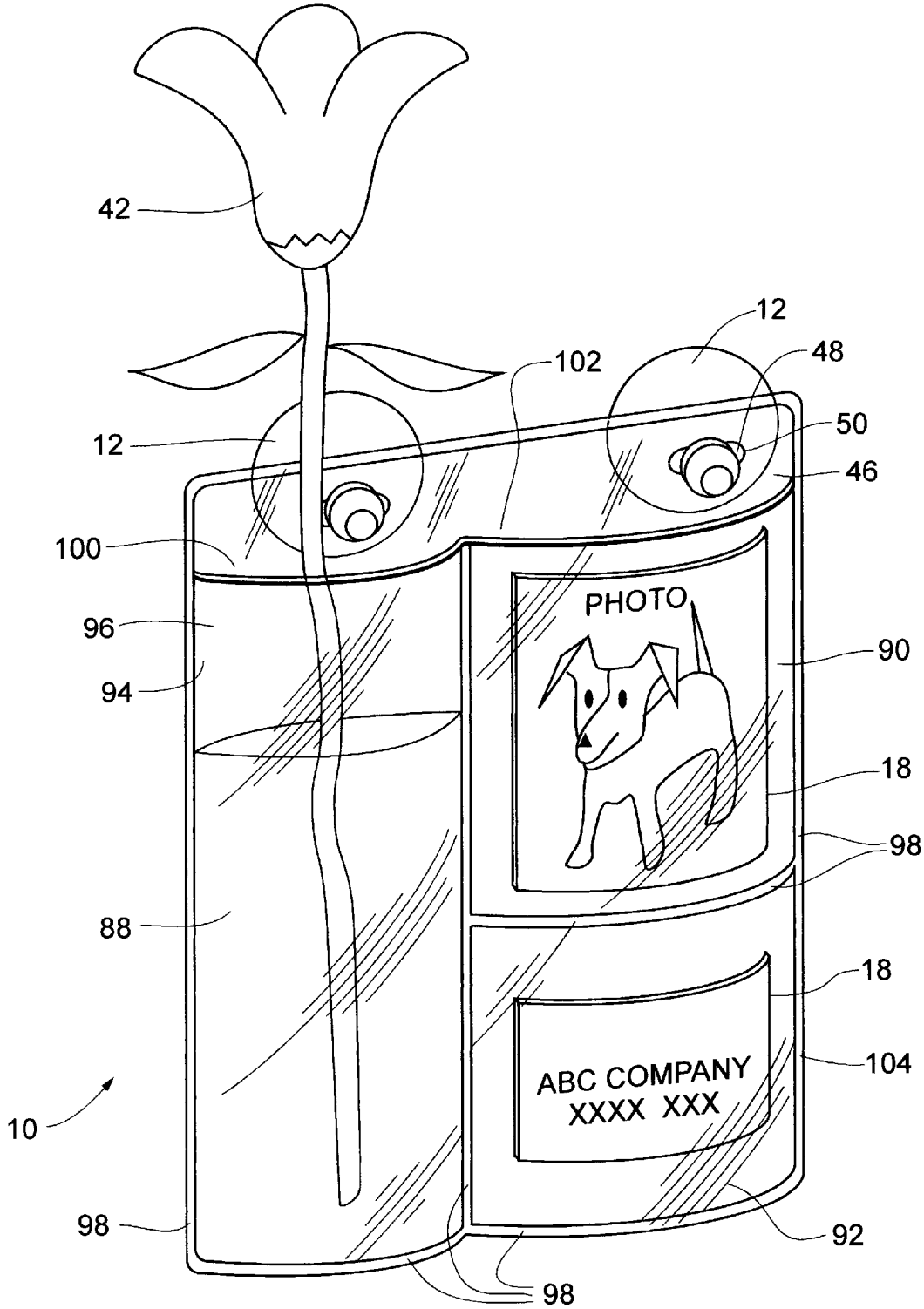
FIG. 9 is a perspective view of a sixth embodiment of the present invention.

Like the other embodiments, one ply of the vase 10 in FIG. 9 preferably extends upward beyond the mouth 100 to form a flap 46. The flap has two button holes 48 bounded by flexible button hole peripheries 50. Through engagement of the peripheries and the buttons, as discussed above, the plies may be repeatedly fastened to and unfastened from the suction cups 12 to suspend the vase 10 from a smooth surface.

Figure 7:
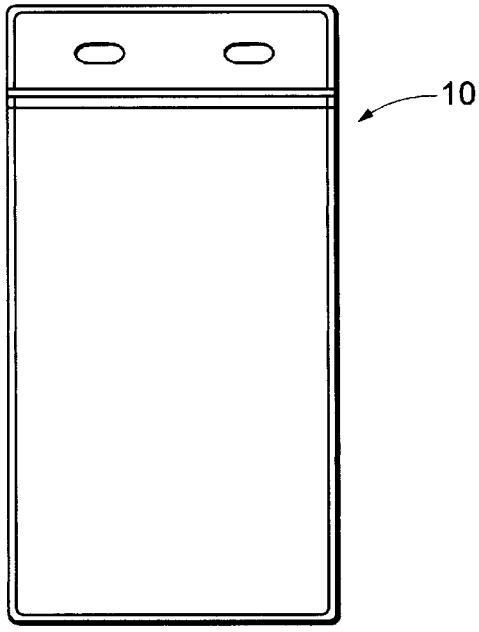
FIG. 7 is a front elevational view of a fourth embodiment of the present invention.

While a preferred embodiment of the present invention has been described, it should be understood that various changes, adaptations and modifications may be made therein without departing from the spirit of the invention and the scope of the appended claims. For instance, the vase 10 may be formed in an unlimited variety of other shapes, such as the rectangular vase 10 shown in FIG. 7. Other possible shapes include a spherical bulb, a flute, a single bud vase, etc.

What is claimed is:

1. A flexible vase mountable to a surface comprising:

a watertight pouch defining an interior space and having an upwardly facing mouth that is unsealed and open for receiving stems of flowers within the interior space, the pouch being comprised of front and rear generally planar, flexible, water impervious wall portions disposed so as to face each other, each wall portion having a periphery sealed to the periphery of the other of the wall portions other than at the mouth such that the wall portions together define the interior space of the pouch therebetween, one of the wall portions having a button hole defined by a flexible button hole periphery, the pouch being removably downwardly suspendible from the button hole periphery, the flexible vase including a front card pocket comprising a layer of flexible material having a periphery sealed to the front wall portion to form the card pocket separate from and in front of said interior space of the pouch, the pocket having an open mouth for receiving a card into the space between the layer and the front wall portion.

2. The flexible vase of claim 1 further including an all-flexible suction cup, the suction cup having a cup side adapted for mounting the cup to a generally vertical smooth surface, the cup having a button side opposite the cup side, the button side having a shaft extending axially from the cup side, the shaft terminating in a button having a cross-section greater than that of the shaft, the pouch being removably downwardly suspendible from the suction cup by stretching the button hole periphery over the button to surround the shaft, thereby creating an all-flexible union between the suction cup and the pouch.

3. The flexible vase of claim 1 wherein the card pocket is generally transparent.

* * * * *